US006270237B1

(12) United States Patent
Scholler

(10) Patent No.: US 6,270,237 B1
(45) Date of Patent: Aug. 7, 2001

(54) ELECTRIC LAMP WITH AN ANTI-REFLECTING LAYER

(75) Inventor: Klaus Scholler, Nideggen (DE)

(73) Assignee: U.S. Philips Corporation, N.Y., NY (US)

( * ) Notice: Subject to any disclaimer, the term of this patent is extended or adjusted under 35 U.S.C. 154(b) by 0 days.

(21) Appl. No.: 09/271,198

(22) Filed: Mar. 17, 1999

(30) Foreign Application Priority Data

Mar. 26, 1998 (EP) ..... 98200960

(51) Int. Cl.[7] ..... F21V 7/14

(52) U.S. Cl. ..... 362/255; 362/351; 313/635; 313/573

(58) Field of Search ..... 362/351, 255; 313/634, 635, 578, 579, 573, 112, 113, 115, 316

(56) References Cited

U.S. PATENT DOCUMENTS 3,784,861 * 1/1974 Noteltier ..... 313/117
4,288,713 * 9/1981 Marlor ..... 313/117
4,305,016 * 12/1981 Schmidt ..... 313/117
4,506,185 * 3/1985 Gillert ..... 313/113
4,794,297 * 12/1988 Gaugel ..... 313/117
5,506,464 * 4/1996 Ooms ..... 313/113
5,619,102 * 4/1997 Scholler ..... 313/635
5,646,471 * 7/1997 Scholler ..... 313/25

FOREIGN PATENT DOCUMENTS 3040812 5/1982 (DE) .
0354620 8/1989 (EP) ..... H01K/1/32
0358273 * 9/1989 (EP) .
0561701 3/1993 (EP) ..... F21Q/1/00

* cited by examiner

*Primary Examiner*—Sandra O'Shea
*Assistant Examiner*—Hargobind S. Sawhney
(74) *Attorney, Agent, or Firm*—Dicran Halajian

(57) ABSTRACT

A lamp has a metal layer to prevent light escaping in an undesired direction. A sealed envelope wall encloses an interior space in which an electrical element is arranged. The wall is partly coated by the metal layer, preferably at a lamp end opposite a lamp cap. A light diffusing or absorbing layer over a side of the metal layer facing the interior space prevents light reflection back into the interior space. For use as a vehicle headlamp, the metal layer may be silvery as viewed from the outside so that it is not noticeable.

11 Claims, 1 Drawing Sheet

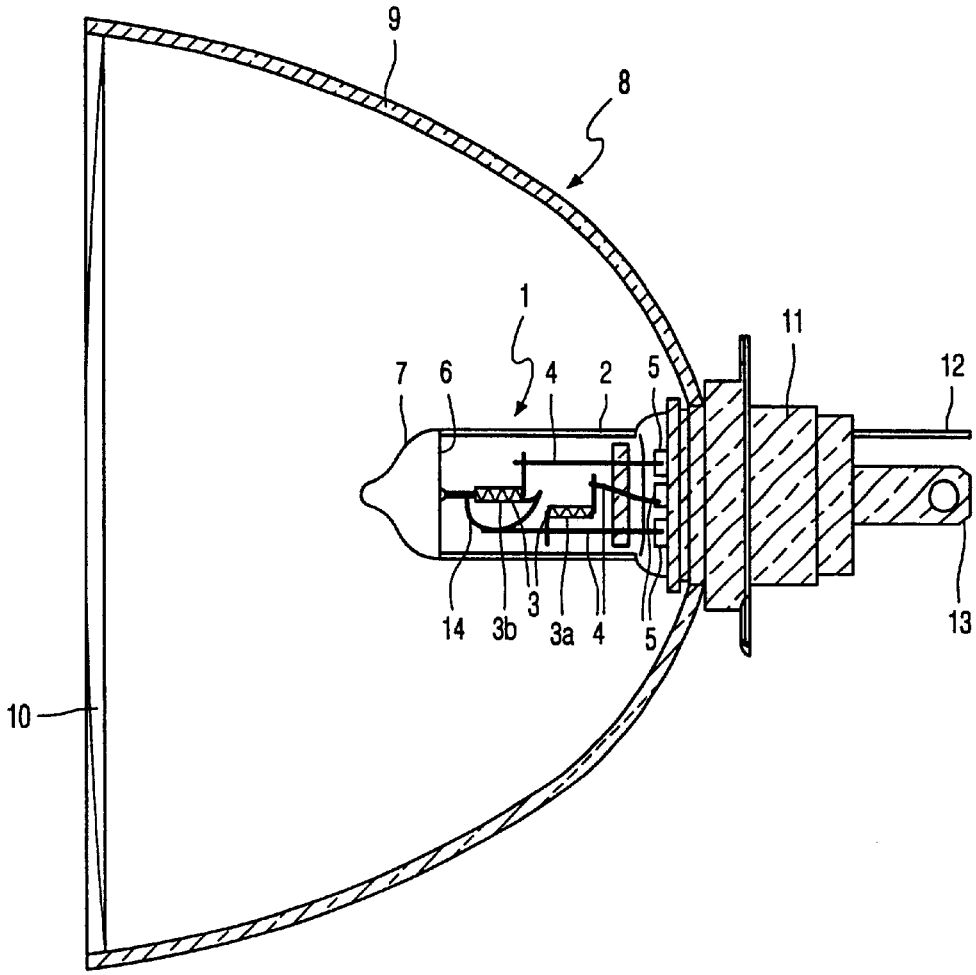
9
8
1
11
12
7
6
4
2
5
14
3b
3
3a
4
5
13
10

ELECTRIC LAMP WITH AN ANTI-REFLECTING LAYER

BACKGROUND OF THE INVENTION

The invention relates to an electric lamp comprising:

a lamp vessel closed in a vacuumtight manner and having a wall enclosing the interior space;

an electric element arranged in the interior space of the lamp vessel; and a metal layer provided on a substrate.

Such an electric lamp is known from DE 3040812-A1.

The known lamp is designed for use as a vehicle headlamp and is for this purpose accommodated in a reflector which has a light emission window. A non-translucent shield is placed over part of the lamp in order to prevent that light originating from the electric element will emerge directly through the light emission window of the reflector during lamp operation. This shield is partly surrounded by a hollow cylinder. The metal layer is present on the wall of the hollow cylinder which also partly surrounds the lamp vessel. Among the favorable properties of the metal layer is that it gives the lamp a colorless appearance in the switched-off state.

A disadvantage of this separate, non-translucent shield, the separate hollow cylinder, and the metal layer provided thereon, is that they lead to undesirable reflections of the light generated in the electric element. A comparatively large fraction of the light issues to the exterior through the light emission window at unfavorable angles during lamp operation as a result of this, which involves a serious risk of glare for other road users.

A further disadvantage is that the lamp has a comparatively heavy, complicated construction which is difficult to assemble owing to the many separate components.

SUMMARY OF THE INVENTION

According to the invention, the substrate of the metal layer is formed by the wall of the lamp vessel, and the metal layer is provided with means for preventing light reflection at its side which faces the electric element.

The lamp according to the invention can be manufactured in a very easy and simple manner. The metal layer is reflecting and non-translucent, so that the lamp has the advantage that the separate shield and the hollow cylinder are no longer necessary. Undesirable reflections against the individual components cannot take place anymore, so that light issuing from the light emission window at unfavorable angles as a result of these reflections and the concomitant risk of glare, for example on the part of other road users, are counteracted.

To prevent reflection of light at the side of the metal layer facing the electric element, the wall or the metal layer is locally provided with a non-reflecting surface, for example made non-translucent, for example frosted by usual techniques, for example by etching or sandblasting. The light is diffusely scattered at this area because the non-reflecting surface has been frosted. Unfavorable reflections of light against this metal layer do not occur. The reflecting properties of the side of the metal layer facing the light emission window gives the lamp, when placed in the reflector, the advantage of a colorless appearance, so that the lamp vessel is substantially invisible through the light emission window. This is perceived as an advantage especially by consumers, because a visible disturbance of the mirroring surface of the reflector by the lamp vessel creates an impression of the reflector being partly fractured or locally attacked.

In a favorable embodiment, the wall is made non-translucent in that a light-absorbing layer, for example a black layer, is provided on the side of the metal layer facing the electric element. The risk of glare is further reduced thereby because the light is not even scattered diffusely anymore, but is absorbed by the light-absorbing layer before light can be reflected against the metal layer. The fact that the light-absorbing layer is coated with the metal layer at the side facing the light emission window means that the lamp retains the advantage of the lamp vessel having a colorless appearance through the light emission window of the reflector and being substantially invisible.

It is important with the use of the lamp in an optical system, for example a reflector, that the lamp vessel should be correctly positioned and fixed therein. The alignment and fixation of the lamp vessel in the optical system is comparatively difficult. If the lamp vessel is provided with a lamp cap, the alignment and fixation of the lamp vessel may be achieved by means of this lamp cap. Since the lamp cap cooperates with the optical system, it will occupy a predetermined position in the optical system as a result. The lamp vessel fitted with such a lamp cap can be aligned and fixed comparatively easily relative to the lamp cap outside the optical system, such that the lamp vessel will occupy an accurately defined position in the optical system owing to the cooperation between the lamp cap and the optical system.

The lamp according to the invention may preferably be used as a vehicle headlamp. The risk of hazardous situations in road traffic is reduced in that dazzling of other road users by light issuing unfavorably from the light emission window is counteracted.

The lamp vessel may be made from hard glass or from quartz glass, i.e. glass with an $SiO_2$ content of more than 95% by weight.

The layers may be provided by usual techniques, for example by spraying or suspension techniques. The metal layer is, for example, silvery, for example made from one of the elements Ag, Al, Au, Cr, Cu, Ni, Pd, Pt, Rh, or mixtures thereof. The (black) light-absorbing layer is, for example, a paint comprising a pigment, for example ethyl-silicate paint with a mixture of transition metal oxides therein, for example of Fe, Mn, Ti, or of silicon as the black pigment.

Current feed-throughs may be embedded next to one another in one wall region, or in regions spaced away from one another, for example lying opposite one another.

The electric element may be an incandescent body, in which case the lamp vessel will preferably contain a filling comprising halogen, for example a rare gas with $CH_2Br_2$. The electric element may alternatively be a pair of electrodes, in which case the lamp vessel will contain an ionizable filling, for example a rare gas, mercury, and a mixture of metal halides.

The electric element may be made (partly) from undoped or doped tungsten. In the case of doped tungsten, a small percentage of means for regulating crystal growth may have been added, such as 0.01% by weight of K, Al, and Si together so as to influence the grain size of the tungsten.

BRIEF DESCRIPTION OF THE DRAWINGS

FIG. 1 is a side cross-section of the lamp according to the invention.

DETAILED DESCRIPTION OF THE PREFERRED EMBODIMENTS

In the drawing, the lamp has a lamp vessel which is closed in a vacuumtight manner and which has a quartz glass wall 2, with an electric element 3 consisting of two separate incandescent bodies 3*a* and 3*b* for a main beam and a passing beam, respectively, inside the lamp vessel 1. The incandescent body 3*b* for the passing beam is partly screened off by a metal shield 14. The incandescent body 3 is connected to current feed-throughs 5, metal foils made of Mo with 0.5% $Y_2O_3$ by weight in the drawing, via internal current conductors 4, made of Mo in the embodiment. The current feed-throughs 5 are embedded next to one another in the wall 2 of the lamp vessel 1.

On the wall 2 of the lamp vessel 1, a first, black layer 6 is provided, consisting of ethyl-silicate paint with a mixture of magnetite ($Fe_3O_4$), manganese dioxide ($MnO_2$), carbonyl iron (pure Fe), and titanium dioxide ($TiO_2$) as a black pigment therein. A second, silvery metal layer 7 of aluminum is provided over the first, black layer 6.

The lamp vessel 1 has a filling of Kr and $CH_2Br_2$, for example at a pressure of 5 bar at room temperature, and when operated at a rated voltage of 12 V will dissipate a power of 55 W.

The lamp vessel 1 is accommodated in a parabolic reflector 8. The light generated by the electric element 3 will issue to the exterior through a light emission window 10 after being reflected by a reflecting layer 9.

The lamp vessel 1 is fixed in a lamp cap 11. The external current conductors are connected to respective contact tags 12, 13 of the lamp cap 11, two of which are visible in the drawing. A lamp in accordance with this embodiment is highly suitable for use as a vehicle headlamp.

What is claimed is:

1. An electric lamp comprising:

a lamp vessel closed in a vacuumtight manner and having a wall enclosing an interior space;

an electric element arranged in the interior space of the lamp vessel;

a metal layer provided on a portion of said wall of the lamp vessel, and having a side facing the interior space; and means for preventing light reflection from said metal layer, said means being located at said side of said metal layer facing the interior space.

2. A lamp as claimed in claim 1 wherein the means for preventing light reflection diffusely scatters light from within the interior space.

3. A lamp as claimed in claim 1 wherein the metal layer is reflecting as viewed from outside the lamp vessel.

4. A lamp as claimed in claim 1 wherein the lamp vessel has two ends, one said end is provided with a lamp cap, and the metal layer is provided on the other end.

5. A lamp as claimed in claim 1 wherein the lamp is a vehicle headlamp.

6. A lamp as claimed in claim 1 wherein the means for preventing light reflection comprises a light-absorbing layer on the side of the metal layer which faces the interior space.

7. A lamp as claimed in claim 6 wherein the metal layer is reflecting as viewed from outside the lamp vessel.

8. A lamp as claimed in claim 7 wherein the lamp vessel is provided with a lamp cap.

9. A lamp as claimed in claim 7 wherein the lamp is a vehicle headlamp.

10. An electric lamp comprising:

a lamp vessel closed in a vacuumtight manner and having a wall enclosing an interior space;

an electric element arranged in the interior space of the lamp vessel; and a metal layer provided on a portion of said wall of the lamp vessel, and having a side facing the interior space, wherein at least a portion of said side of said metal layer facing the interior space is configured to be a non-reflecting surface.

11. An electric lamp comprising:

a lamp vessel closed in a vacuumtight manner and having a wall enclosing an interior space;

an electric element arranged in the interior space of the lamp vessel;

a metal layer provided on a portion of said wall of the lamp vessel, and having a side facing the interior space; and a coating formed on at least a portion of said side of said metal layer facing the interior space, said coating preventing light reflection from said metal layer.

* * * * *